US009637851B2

(12) United States Patent
Okuda et al.

(10) Patent No.: US 9,637,851 B2
(45) Date of Patent: May 2, 2017

(54) METHOD AND DEVICE FOR RECOVERING BULK OF NONWOVEN FABRIC

(71) Applicant: UNICHARM CORPORATION, Ehime (JP)

(72) Inventors: Jun Okuda, Kagawa (JP); Ko Detani, Kagawa (JP); Toru Oba, Kagawa (JP); Satoshi Mitsuno, Kagawa (JP); Noritomo Kameda, Kagawa (JP)

(73) Assignee: Unicharm Corporation, Ehime (JP)

( * ) Notice: Subject to any disclaimer, the term of this patent is extended or adjusted under 35 U.S.C. 154(b) by 375 days.

(21) Appl. No.: 14/395,028

(22) PCT Filed: Apr. 18, 2013

(86) PCT No.: PCT/JP2013/061524

§ 371 (c)(1),
(2) Date: Oct. 16, 2014

(87) PCT Pub. No.: WO2013/157611

PCT Pub. Date: Oct. 24, 2013

(65) Prior Publication Data

US 2015/0067996 A1 Mar. 12, 2015

(30) Foreign Application Priority Data

Apr. 20, 2012 (JP) ..... 2012-097087

(51) Int. Cl.
*D06C 7/00* (2006.01)
*D06B 3/10* (2006.01)
(Continued)

(52) U.S. Cl.
CPC ..... *D06C 7/00* (2013.01); *D04H 1/50* (2013.01); *D06B 1/00* (2013.01); *D06B 3/10* (2013.01)

(58) Field of Classification Search
CPC ... D06C 7/00; D06C 7/02; D06B 3/10; D06B 3/20; D06B 3/201; D06B 3/22;
(Continued)

(56) References Cited

U.S. PATENT DOCUMENTS 2,306,019 A * 12/1942 Hanson ..... D06C 3/00 34/225
RE23,384 E * 7/1951 Dungler ..... D06C 7/00 26/92

(Continued)

FOREIGN PATENT DOCUMENTS

JP H08-173471 A 7/1996
JP 2004-137655 A 5/2004

(Continued)

OTHER PUBLICATIONS

International Search Report from corresponding PCT application No. PCT/JP2013/061524 dated Jul. 2, 2013 (4 pgs).

*Primary Examiner* — Amy Vanatta
(74) *Attorney, Agent, or Firm* — Brinks Gilson & Lione

(57) ABSTRACT

A device and method for excellent recovery of bulk in nonwoven fabric. While nonwoven fabric is transported so as to enter a heating chamber via an entry opening and, after progressing within the heating chamber, exit the heating chamber via an exit opening, heated air is supplied at a speed higher than the transport speed for the unwoven fabric so as to enter the heating chamber via the entry opening and after progressing within the heating chamber while contacting the nonwoven fabric, exit the heating chamber via the exit opening.

20 Claims, 3 Drawing Sheets

(51) Int. Cl.
*D06B 1/00* (2006.01)
*D04H 1/50* (2012.01)

(58) Field of Classification Search
CPC ... D06B 3/28; D06B 1/00; D06B 1/02; D06B 19/00; D06B 19/0035; D06B 19/0052; D06B 5/08; F26B 3/04; F26B 3/06; F26B 3/08; D04H 1/50
USPC .... 28/167, 271, 273; 34/445, 447, 448, 444; 68/5 C, 5 D, 5 E
See application file for complete search history.

(56) References Cited

U.S. PATENT DOCUMENTS 2,590,849 A * 4/1952 Dungler ..... D06C 7/00 34/448
3,078,496 A * 2/1963 Doran ..... B41F 23/002 15/309.1
3,763,669 A 10/1973 Bous et al.
3,766,662 A * 10/1973 Moyer ..... D06C 7/00 34/212
3,868,215 A * 2/1975 Frezza ..... B65H 19/2253 26/81
4,270,283 A * 6/1981 Ellis ..... F26B 13/10 34/212
5,678,429 A * 10/1997 Zonco ..... B65H 20/10 26/21
5,746,072 A * 5/1998 Bohnke ..... D06B 3/28 226/97.4
6,168,743 B1 * 1/2001 Reese ..... D02J 13/001 264/345
7,268,323 B2 * 9/2007 Tomobe ..... B29C 71/02 219/388
2004/0016143 A1 * 1/2004 Cleary ..... D06C 7/00 34/394
2004/0111848 A1 6/2004 Miyamoto et al.
2011/0126388 A1 6/2011 Takabayashi et al.
2011/0191994 A1 8/2011 Takahashi
2012/0060388 A1 * 3/2012 Rocheleau ..... F26B 13/101 34/659

FOREIGN PATENT DOCUMENTS

JP 2007-177364 A 7/2007
JP 2010-7219 A 1/2010
JP 2010-156076 A 7/2010
WO WO 2010/047292 A1 4/2010
WO WO 2010/074207 A1 7/2010

* cited by examiner (A)

(B)

METHOD AND DEVICE FOR RECOVERING BULK OF NONWOVEN FABRIC

RELATED APPLICATION

This application is a 35 U.S.C. §371 national phase filing of International Patent Application No. PCT/JP2013/061524, filed Apr. 18, 2013, through which and to which priority is claimed under 35 U.S.C. §119 to Japanese Patent Application No. 2012-097087, filed Apr. 20, 2012.

TECHNICAL FIELD

The present invention relates to a method and system for restoring bulk of a nonwoven fabric.

BACKGROUND ART

A nonwoven fabric is formed into a strip, then is wound up in the form of a roll for storage. When next using the nonwoven fabric, the nonwoven fabric is unwound from the roll. The nonwoven fabric is, for example, used as a component member such as a top sheet of an absorbent product such as a disposable diaper or sanitary napkin.

In this regard, if the nonwoven fabric is wound up in the form of a roll, the nonwoven fabric will be compressed in the thickness direction and the nonwoven fabric will be liable to be reduced in bulk or thickness. If the nonwoven fabric is reduced in bulk, the nonwoven fabric is liable to fall in speed of liquid absorption or fall in flexibility.

On the other hand, if heating the nonwoven fabric, the nonwoven fabric which was deformed by compression will be returned to the original state in terms the fiber and the bulk of the nonwoven fabric will be restored.

Therefore, there is known a method of blowing hot air on to nonwoven fabric to restore bulk of the nonwoven fabric (see PLT 1). In this method, the hot air is blown vertical to one surface of the nonwoven fabric.

Further, there is also known another method for restoring bulk of a nonwoven fabric comprising making the nonwoven fabric snake so as to proceed alternately in a mutually opposite first direction and second direction while supplying hot air in a second direction (see PLT 2, FIG. 6).

CITATIONS LIST

Patent Literature

PLT 1: Japanese Unexamined Patent Publication (kokai) No. 2004-137655A

PLT 2: Japanese Unexamined Patent Publication (kokai) No. 2007-177364A

SUMMARY OF INVENTION

Problems to be Solved by the Invention

However, with the method of PLT 1, due to the hot air, a force in a direction compressing the nonwoven fabric acts on the nonwoven fabric. Therefore, the restoration of bulk of the nonwoven fabric is liable to be obstructed by the hot air. That is, the bulk of the nonwoven fabric is liable not to be restored well.

With the method of PLT 2, to restore the bulk, hot air must be run through the nonwoven fabric. Therefore, the same problem as PLT 1 can arise.

Means for Solving the Problems

According to a first aspect of the present invention, there is provided a method for restoring bulk of a strip-shaped nonwoven fabric, which method includes a step of providing a heating chamber which has an inlet and outlet and a step of conveying a nonwoven fabric so as to enter the heating chamber through the inlet, proceed through the inside of the heating chamber, then exit the heating chamber through the outlet while feeding a heated fluid by a speed faster than the speed of conveyance of the nonwoven fabric so as to enter the heating chamber through one of the inlet and outlet, proceed through the inside of the heating chamber while contacting the nonwoven fabric, then exit from the inside of the heating chamber through the other of the inlet and outlet.

According to a second aspect of the present invention, there is provided a system for restoring bulk of a strip-shaped nonwoven fabric, which system includes a heating chamber which has an inlet and outlet, a conveyor which conveys a nonwoven fabric to enter the heating chamber through the inlet, proceed through the inside of the heating chamber, then exit the heating chamber through the outlet, and a feeder which feeds a heated fluid by a speed faster than the speed of conveyance of the nonwoven fabric so as to enter the heating chamber through one of the inlet and outlet, proceed through the inside of the heating chamber while contacting the nonwoven fabric, then exit from the inside of the heating chamber through the other of the inlet and outlet.

Advantageous Effects of Invention

It is possible to restore the bulk of a nonwoven fabric well.

MODE FOR CARRYING OUT THE INVENTION

Figure 1:
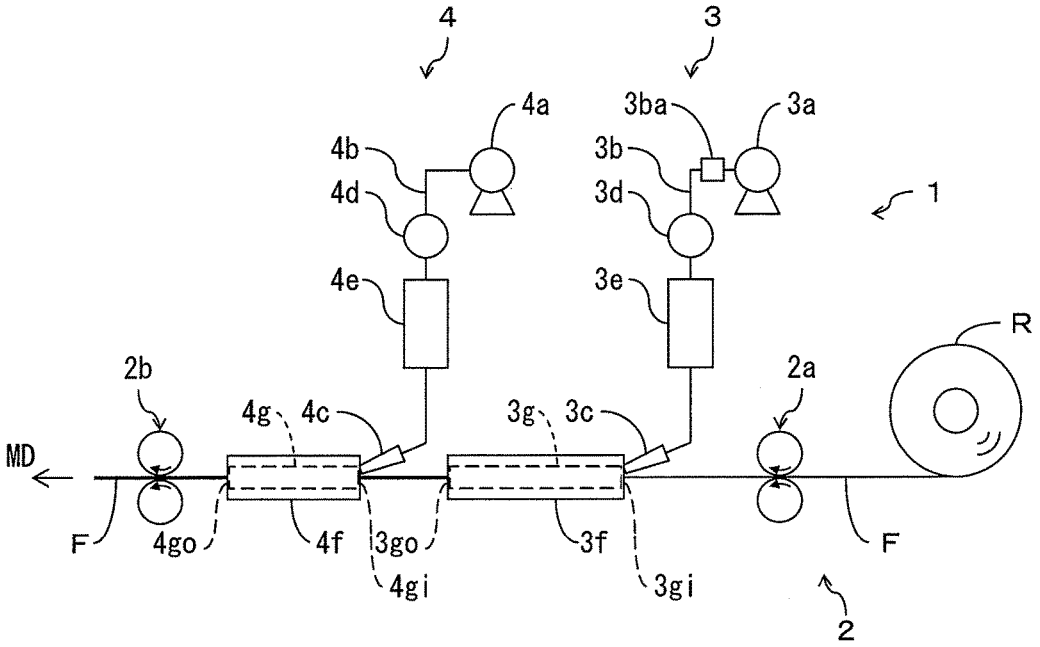
FIG. 1 is an overall view of a bulk restoring system.

Referring to FIG. 1, the system 1 for restoring bulk of a nonwoven fabric is provided with a conveyor 2 which conveys a strip shaped nonwoven fabric F while unwinding it from a roll R. In this embodiment according to the present invention, the conveyor 2 is provided with two pairs of rollers 2*a* and 2*b*. The pairs of rollers 2*a* and 2*b* are provided with rollers which rotate in opposite directions. When these rollers are rotated, the nonwoven fabric F is conveyed. Further, in this embodiment according to the present invention, the nonwoven fabric F is conveyed in the machine direction MD substantially matching the horizontal direction so that one surface and the other surface generally face upward and downward.

The bulk restoring system 1 is further provided with a heater 3 for heating the conveyed nonwoven fabric F by a fluid. The heater 3 is provided with a fluid source 3*a*, a feed pipe 3*b* which is coupled with an outlet of the fluid source 3*a*, a nozzle 3*c* which is coupled with an outlet of the feed pipe 3*b*, a flowmeter 3*ba* which is arranged in the feed pipe 3*b*, a regulator 3*d* which is arranged inside of the feed pipe 3*b* downstream of the flowmeter 3*ba*, an electric heater 3*e* which is arranged inside the feed pipe 3*b* downstream of the regulator 3*d*, and a housing 3*f*. The nozzle 3*c*, for example, has an elongated rectangular shaped outlet.

In this embodiment according to the present invention, the fluid is air, while the fluid source 3*a* is a compressor. If the compressor 3*a* is operated, air flows through the feed pipe 3*b*. The flowmeter 3*ba* detects the flow rate of air which flows through the feed pipe 3*b* and outputs the air flow rate in the form of the rate in a standard state (0° C., 1 atm). The air pressure in the feed pipe 3*b* is reduced by the regulator 3*d* from, for example, 0.6 MPaG to 3 MPaG to 0.01 MPaG. The air is next heated by the electric heater 3*e*. The heated air next flows out from the nozzle 3*c*. The rate of air which flows out from the nozzle 3*c* is, for example, 440 liter/min (0.44 $m^3$/min, standard state). The temperature of the air which flows out from the nozzle 3*c* is made to become, for example, 70 to 90° C. by the air being heated by the electric heater 3*e* to, for example, 100 to 140° C. Note that, the temperature of the air which flows out from the nozzle 3*c* can be detected by a temperature sensor which is arranged near the outlet of the nozzle 3*c*.

Figure 2:
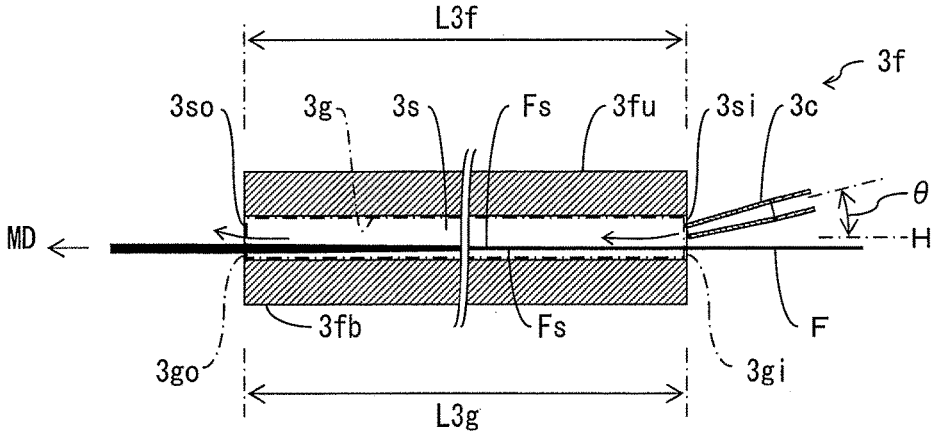
FIG. 2 is an enlarged cross-sectional view of a heating chamber.
Figure 3:
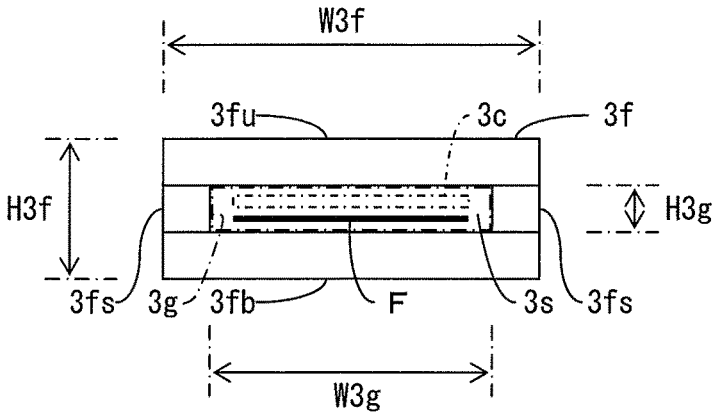
FIG. 3 is a view of an end face of a heating chamber.

As shown in FIG. 2 and FIG. 3, the housing 3*f* is provided with an upper wall 3*fu* and bottom wall 3*fb* which extend in the horizontal direction while separated from each other and a pair of side walls 3*fs* and 3*fs* which are arranged between the upper wall 3*fu* and bottom wall 3*fb*. These upper wall 3*fu*, bottom wall 3*fb*, and side walls 3*fs* and 3*fs* define a cross-sectional rectangular shaped internal space 3*s*. The internal space 3*s* is provided with a mutually facing pair of openings 3*si* and 3*so*.

Inside the internal space 3*s* downstream of the outlet in the nozzle 3*c*, a heating chamber 3*g* which has inlets 3*gi* and 3*go* is defined. In this embodiment according to the present invention, the outlet of the nozzle 3*c* is arranged at an opening 3*si* of the internal space 3*s*. Therefore, the heating chamber 3*g* matches with the internal space 3*s*. Further, the inlet 3*gi* of the heating chamber 3*g* matches the opening 3*si* of the internal space 3*s*, while the outlet 3*g* of the heating chamber matches the opening 3*so* of the internal space 3*s*.

The nonwoven fabric F is conveyed by the conveyor 2 to enter the heating chamber 3*g* through the inlet 3*gi*, proceed through the inside of the heating chamber 3*g*, then exit the heating chamber 3*g* through the outlet 3*go*. In this case, inside the heating chamber 3*g*, no rollers or belt is arranged for conveying the nonwoven fabric F. In other words, the nonwoven fabric F is conveyed in the heating chamber 3*g* without being supported. Further, the nonwoven fabric F is conveyed through the inside of the heating chamber 3*g* so that the two surfaces Fs of the nonwoven fabric F continue to face the partition walls which partition the heating chamber 3*g*, that is, the upper wall 3*fu* and bottom wall 3*fb*.

On the other hand, the air which flows out from the nozzle 3*c* enters the heating chamber 3*g* through the inlet 3*gi*, proceeds through the inside of the heating chamber 3*g* while contacting the conveyed nonwoven fabric F, then exits the heating chamber 3*g* through the outlet 3*go*. In this case, inside the heating chamber 3*g*, air is fed so that the linear speed of the air becomes higher than the speed of conveyance of the nonwoven fabric F.

Further, in this embodiment according to the present invention, the upper wall 3*fu* and bottom wall 3*fb* are, for example, formed from thickness 3 mm stainless steel sheets. The length L3 of the machine direction MD of the housing 3*f* or heating chamber 3*g* is 1000 mm. The width W3f of the housing 3*f* is 140 mm, while the width W3g of the heating chamber 3*g* is 100 mm. The height H3f of the housing 3*f* is 9 mm, while the height H3g of the heating chamber 3*g* is 3 mm.

Furthermore, in this embodiment according to the present invention, the upper wall 3*fu* and the bottom wall 3*fb* extend in horizontal planes. The angle θ which is formed by the line of orientation of the nozzle 3*c* and the horizontal plane H (see FIG. 2) is preferably 0 to 30 degrees, more preferably 0 to 10 degrees, most preferably 0 degree.

The bulk restoring system 1 is, further, provided with a cooler 4 for cooling the nonwoven fabric F which is conveyed downstream of the heater 3 by a fluid. The cooler 4 is provided with a fluid source 4*a*, a feed pipe 4*b* which is coupled to the outlet of the fluid source 4*a*, a nozzle 4*c* which is coupled to the outlet of the feed pipe 4*b*, a regulator 4*d* and cooling device 4*e* which are arranged inside the feed pipe 4*b*, and a housing 4*f*.

In this embodiment according to the present invention, the fluid is air, while the fluid source 4*a* is a compressor. If the compressor 4*a* is operated, air flows through the feed pipe 4*b*. The air pressure inside of the feed pipe 4*b* is reduced by the regulator 4*d*. The air is then cooled by the cooling device 4*e*. The cooled air then flows out from the nozzle 4*c*.

The housing 4*f* of the cooler 4, like the housing 3*f* of the heater 3, is provided with an upper wall and bottom wall which extend separated from each other and a pair of side walls which are arranged between the upper wall and bottom wall. These upper wall, bottom wall, and side walls are used to define a cross-sectional rectangular cooling chamber 4*g*. The cooling chamber 4*g* is provided with a facing inlet 4*gi* and outlet 4*go*.

The nonwoven fabric F which is unloaded from the heater 3 is conveyed by the conveyor 2 to enter the cooling chamber 4*g* through the inlet 4*gi*, proceed through the inside of the cooling chamber 4*g*, then exit the cooling chamber 4*g* through the outlet 4*go*. In this case, at the inside of the cooling chamber 4*g*, rollers and a belt are not arranged for conveying the nonwoven fabric F. In other words, the nonwoven fabric F is conveyed inside the cooling chamber 4*g* without being supported. Further, the nonwoven fabric F is conveyed through the inside of the cooling chamber 4*g* so that the two surfaces Fs of the nonwoven fabric F continue facing the upper wall and bottom wall serving as partition walls which define the cooling chamber 4*g*.

In this embodiment according to the present invention, the nozzle 4*c* of the cooler 4 is arranged at the inlet 4*gi*. Therefore, the air which flows out from the nozzle 4*c* enters the cooling chamber 4*g* through the inlet 4*gi* and contacts the conveyed nonwoven fabric F while proceeding through the inside of the cooling chamber 4*g*, then exits the cooling chamber 4*g* through the outlet 4*go*. In this case, air is fed into the cooling chamber 4*g* so that the linear speed of the air becomes higher than the speed of conveyance of the nonwoven fabric F.

Now then, the nonwoven fabric F which is unwound from the roll R first is conveyed so as to pass through the inside of the heating chamber 3*g* of the heater 3. Simultaneously, the heated air from the nozzle 3*c* of the heater 3 is fed to the inside of the heating chamber 3*g*. As a result, the nonwoven fabric F contacts the heated air to be heated and the nonwoven fabric F is increased in bulk. That is, the bulk of the nonwoven fabric F is restored.

In this case, air mainly proceeds along the surface Fs of the nonwoven fabric F. As a result, the flow of air does not obstruct the restoration of bulk of the nonwoven fabric F. That is, the bulk of the nonwoven fabric F is restored well.

Furthermore, in this embodiment according to the present invention, in the heating chamber 3*g*, the linear speed of the air is higher than the speed of conveyance of the nonwoven fabric F. As a result, the flow of air adjoining the surface Fs of the nonwoven fabric F is disturbed. For this reason, the molecules which are contained in the air strike the surface Fs of the nonwoven fabric F by a random angle. Therefore, the fiber of the nonwoven fabric F unravels and restoration of bulk is promoted. Further, due to the disturbances in the air flow, the nonwoven fabric F flaps in the heating chamber 3*g*. As a result, the heated air easily enters the inside of the nonwoven fabric F and the nonwoven fabric F can be efficiently heated. For this reason, the length L3f of the heating chamber 3*g* or housing 3*f* (FIG. 2) can be shortened.

Furthermore, the housing 3*f* does not require equipment for feeding air or equipment for sucking out the air. Therefore, the size of the housing 3*f* can be made smaller.

Furthermore, inside the heating chamber 3*g*, the nonwoven fabric F is conveyed without being supported by rolls etc. As a result, restoration of bulk to the nonwoven fabric F is not obstructed by the rolls etc.

The nonwoven fabric F which is unloaded from the heating chamber 3*g* is next conveyed so as to pass through the cooling chamber 4*g* of the cooler 4. At the same time, the cooled air is fed from the nozzle 4*c* of the cooler 4 to the inside of the cooling chamber 4*g*. As a result, the nonwoven fabric F contacts the cooled air to be cooled.

In this case, the air mainly proceeds along the surface Fs of the nonwoven fabric F. As a result, the flow of air obstructs the reduction of the bulk of the nonwoven fabric F.

Further, the linear speed of the air in the cooling chamber 4*g* is higher than the speed of conveyance of the nonwoven fabric F. As a result, the nonwoven fabric F as a whole which is positioned in the cooling chamber 4*g* can be cooled. That is, the nonwoven fabric F can be efficiently cooled. For this reason, the cooling chamber 4*g* and the housing 4*f* can be reduced in size.

The nonwoven fabric F which is unloaded from the cooling chamber 4*g* is next conveyed by the conveyor 2 to, for example, a system for production of absorbent products. In the system for production of absorbent products, the nonwoven fabric F is for example used as the top sheet of an absorbent product.

As the nonwoven fabric, for example, an air-through nonwoven fabric, point bond nonwoven fabric (heat roll nonwoven fabric), spun lace nonwoven fabric, spun bond nonwoven fabric, melt blown nonwoven fabric, or other nonwoven fabric obtained by various methods is used.

As the fiber which forms the nonwoven fabric, for example, a monofilament or composite fiber which is comprised of low density polyethylene, high density polyethylene, linear polyethylene, polypropylene, polyethylene terephthalate, modified polypropylene, modified polyethylene terephthalate, nylon, polyamide, or other thermoplastic resin is used.

As the composite fiber, for example, a core-sheath type with a melting point of the core component higher than a melting point of the sheath component, an eccentric core-sheath type, or a side-by-side type with left and right component with melting points which are different from each other is used. Further, a hollow type fiber, flat, Y-shaped, C-shaped, or other irregularly shaped fiber, latent crimp fiber and 3D crimp fiber with developed crimps, split fiber which is split by flowing water, heat, embossing, or other physical loads, etc. may be mixed together.

To form a 3D crimp shape nonwoven fabric, it is possible to mix in one or both of a latent crimp fiber and developed crimp fiber. A 3D crimp shape includes a spiral shape, zigzag shape, Ω shape, etc. In this case, even if the fiber is oriented in mainly the planar direction, it is partially oriented in the thickness direction. Due to this, the buckling strength of the fiber in the thickness direction of the nonwoven fabric is raised, so even if applying external pressure on the nonwoven fabric, the nonwoven fabric is resistant to reduction of bulk. Further, in the case of a spiral shape, the bulk is easily restored when external pressure on the nonwoven fabric is released.

On the other hand, as explained above, when the nonwoven fabric F is used as a top sheet, as the denier of the nonwoven fabric, considering the ability for liquid to enter it and the feel to the skin, 1.1 to 8.8 dtex is preferable. Further, in this case, for example, to absorb the small amount of menstrual blood, sweat, etc. which remains on the skin, the fiber which forms the nonwoven fabric may be made to contain pulp, chemical pulp, rayon, natural cotton, or other cellulose-based hydrophilic fiber. However, a cellulose-based fiber has trouble releasing once absorbed liquid, so it is preferably contained in 0.1 to 5 mass % in range with respect to the total. Furthermore, considering the impregnability of a liquid or re-wet back, a hydrophobic synthetic fiber may have a hydrophilicity agent or water repellent etc. kneaded into it or coated on it. Further, corona treatment or plasma treatment may be used to give the fiber hydrophilicity.

Further, to raise the whiteness, the fiber may contain titanium oxide, barium sulfate, calcium carbonate, or another inorganic filler. When the fiber is a core-sheath type of composite fiber, just the cores may include the inorganic filler, or the sheath may also include an inorganic filler.

For example, as the nonwoven fabric which is made using the air-through method, a nonwoven fabric which is mainly comprised of a core-sheath fiber with a sheath formed from high density polyethylene and a core formed from polyethylene terephthalate, with a fiber length of 20 to 100 mm, preferably 35 to 65 mm, and with a denier of 1.1 to 8.8 dtex, preferably 2.2 to 5.6 dtex is preferable.

In this embodiment according to the present invention, the nonwoven fabric includes thermoplastic fiber which has crimps. In this case, the temperature of the air which flows out from the nozzle 3*c* of the heater 3 is preferably from a temperature 50 degrees centigrade lower than the melting point of the thermoplastic fiber to less than the melting point. If the air temperature is lower than the melting point minus 50 degrees centigrade, the nonwoven fabric is liable to not be sufficiently restored in bulk. If the air temperature is the melting point or more, the fiber ends up melting.

If considering the efficient heating of the nonwoven fabric F, the heating chamber 3*g* is preferably small in cross-sectional area, that is, width W3g and height H3g. However, at the time of conveyance, the nonwoven fabric F snakes in the width direction and flaps in the thickness direction. For this reason, if the width W3g or height H3g is excessively small, the nonwoven fabric F is liable to strike the housing 3*f*. Further, if the cross-sectional area of the heating chamber 3*g*, that is, the flow area of the air, is excessively small, the pressure loss at the heating chamber 3*g* becomes larger. If considering these, the width W3g is preferably 5 to 40 mm larger than the width of the nonwoven fabric F, more preferably 10 to 20 mm larger than the width of the nonwoven fabric F. Further, the height H3g is preferably 2 to 10 mm, more preferably 3 to 5 mm.

In the embodiment which was explained above to here, the nozzle 3*c* of the heater 3 was arranged at the inlet 3*gi* of the heating chamber 3*g*. In another embodiment, the nozzle 3*c* is arranged at the outlet 3*go* of the heating chamber 3*g*. In this case, air is supplied so as to enter the heating chamber 3*g* through the outlet 3*go*, contact the conveyed nonwoven fabric F while proceeding through the inside of the heating chamber 3*g*, then exit from the heating chamber 3*g* through the inlet 3*gi*.

This being so, this means air is supplied so as to enter the heating chamber 3*g* through one of the inlet 3*gi* and the outlet 3*go*, contact the nonwoven fabric F while proceeding through the inside of the heating chamber 3*g*, then exit from the heating chamber 3*g* through the other of the inlet 3*gi* and outlet 3*go*.

In this regard, if arranging the nozzle 3*c* at the outlet 3*go*, the machine direction MD of the nonwoven fabric F and the air flow become opposite directions from each other. For this reason, the force in the machine direction MD acting on the nonwoven fabric F for conveyance, that is, the tension, has to be increased. If the tension is increased, the restoration of the bulk of the nonwoven fabric F is liable to be obstructed. A similar problem arises when making the nonwoven fabric F alternately snake in the heating chamber 3*g* in the machine direction MD and in a direction opposite to the machine direction MD.

As opposed to this, in the embodiment which is shown in FIG. 1 to FIG. 3, the nozzle 3*c* is arranged at the inlet 3*gi*, and the nonwoven fabric F is conveyed in the heating chamber 3*g* so that the two surfaces Fs of the nonwoven fabric F continue to face the upper wall 3*fu* and bottom wall 3*fb*. Therefore, in the heating chamber 3*g*, the machine direction MD of the nonwoven fabric F and the air flow become the same directions as each other. As a result, the tension which is applied to the nonwoven fabric F for conveyance can be kept small while restoring the bulk.

Further, in the embodiments which were explained up to here, the nozzle 3*c* was arranged at the inlet 3*gi* above the nonwoven fabric F. In another embodiment, the nozzle 3*c* is arranged below the nonwoven fabric F. Furthermore, in another embodiment, nozzles 3*c* are arranged both above and below the nonwoven fabric F.

FIG. 4(A) and FIG. 4(B) show another embodiment of the nozzle 3*c*. Referring to FIG. 4(A), the nozzle 3*c* is, for example, provided with a box shaped body 3*ca*. The body 3*ca* is provided with an internal space 3*cb*, an air inlet 3*cc* and air outlet 3*cd* which are communicated with the internal space 3*cb*, and an air guide plate 3*ce* which extends adjacent to the air outlet 3*cd*. The air inlet 3*cc* is coupled with the feed pipe 3*b*.

This nozzle 3*c* is integrally fastened to the housing 3*f*. That is, as shown in FIG. 4(B), the air guide plate 3*ce* of the nozzle 3*c* is inserted into the internal space 3*s* through the inlet 3*si* of the internal space 3*s* of the housing 3*f*, while the body 3*ca* is fastened to the upper wall 3*fu* of the housing 3*f*. As a result, an air passage 5*a* is formed between the air guide plate 3*ce* and the upper wall 3*fu*, while a nonwoven fabric passage 5*b* is formed between the air guide plate 3*ce* and the bottom wall 3*fb*. In this case, the height H5a of the air passage 5*a*, the thickness t3ce of the air guide plate 3*ce*, and the height H5b of the nonwoven fabric passage 5*b* are, for example, respectively 1 mm. Note that, the width of the nozzle 3*c* substantially matches the width of the internal space 3*s*.

The air passage 5*a* is on the one hand communicated with the air outlet 3*cd* of the nozzle 3*c*, while on the other hand is communicated with the internal space 3*s* of the housing 3*f*. In this case, the heating chamber 3*g* is defined downstream of the outlet of the air passage 5*a*. Therefore, the heated air which is supplied from the feed pipe 3*b* to the body 3*ca* flows through the air outlet 3*cd* to the inside of the air passage 5*a*, runs through the inside of the air passage 5*a*, then flows through the inlet 3*gi* to the inside of the heating chamber 3*g*.

The nonwoven fabric passage 5*b* is on the one hand communicated with the outside of the housing 3*f*, while on the other hand is communicated with the heating chamber 3*g*. The nonwoven fabric F enters the nonwoven fabric passage 5*b* from outside of the housing 3*f*, proceeds through the inside of the nonwoven fabric passage 5*b*, then enters the heating chamber 3*g* through the inlet 3*gi*.

In this case, the flow area at the outlet 3*go* of the heating chamber 3*g* is larger than the flow area of the nonwoven fabric passage 5*b*, therefore the flow resistance at the outlet 3*go* becomes smaller than the flow resistance of the nonwoven fabric passage 5*b*. Therefore, the air which flows through the inlet 3*gi* to the inside of the heating chamber 3*g* is kept from flowing backward through the inside of the nonwoven fabric passage 5*b* and can reliably flow toward the outlet 3*go* through the inside of the heating chamber 3*g*.

Figure 4:
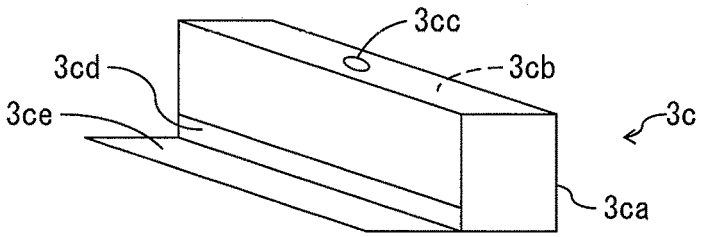
FIG. 4 is a view which shows another embodiment according to the present invention.
Figure 4:
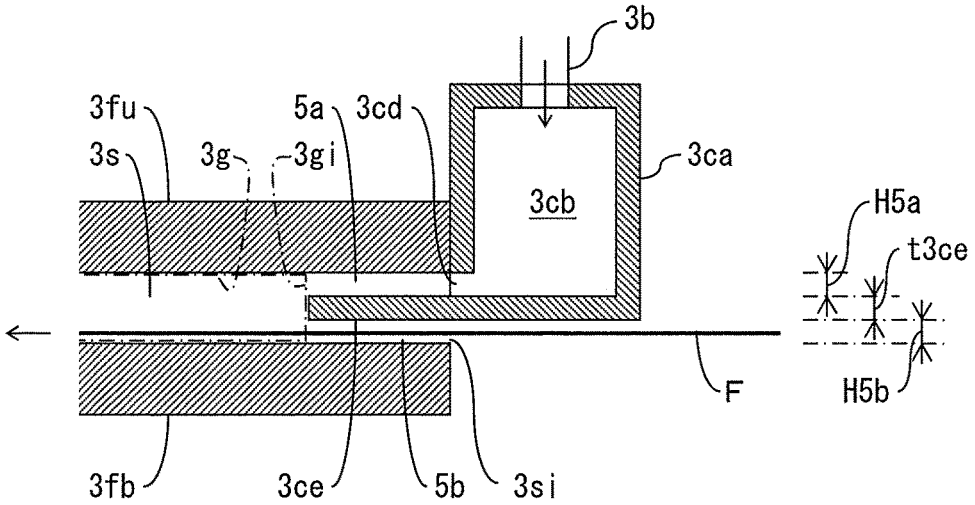
Figure 5:
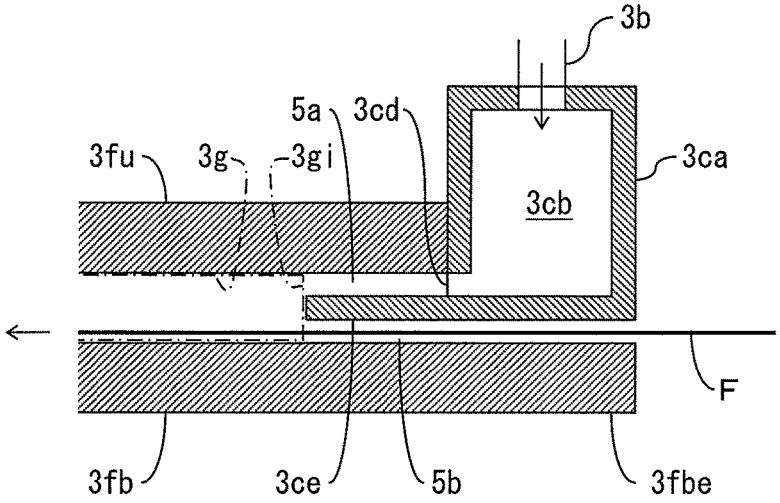
FIG. 5 is a view which shows still another embodiment according to the present invention.

In the embodiment which is shown in FIG. 5, compared with the embodiment which is shown in FIG. 4, the bottom wall 3*fb* of the housing 3*f* is extended to below the body 3*ca* of the nozzle 3*c*. As a result, the nonwoven fabric passage 5*b* is also extended to below the body 3*ca* of the nozzle 3*c*.

The arrangement of the nozzle 4*c* of the cooler 4 is similar to the arrangement of the nozzle 3*c* of the heater 3.

Furthermore, in the embodiments which were explained up to here, the cooler 4 was provided downstream of the heater 3. In another embodiment, the cooler 4 is omitted. That is, the nonwoven fabric F which is unloaded from the heater 3 is conveyed to the production system without being cooled by the cooler 4.

In still another embodiment, a buffer is provided in the feed pipe 3*b* between the compressor 3*a* and the regulator 3*d*. Due to this buffer, fluctuations of the pressure in the feed pipe are suppressed. The volume of the buffer is, for example, 400 liters (0.4 $m^3$).

In still another embodiment, a heater is provided for heating the housing 3*f*. Due to this heater, the temperature of the inside surface of the housing 3*f* which defines the heating chamber 3*g* is, for example, maintained at substantially the same temperature as the temperature of the air which flows out from the nozzle 3*c*. By doing this, restoration of bulk of the nonwoven fabric F is promoted. As the heater for the housing 3*f*, it is possible to use a silicone rubber heater made by Threehigh. In still another embodiment, a heater is provided for heating the nozzle 3*c*.

In still another embodiment, a heat insulating material is provided which covers the housing 3*f*. Due to this heat insulating material, the drop in temperature at the inside of the housing 3*f* or the inside of the heating chamber 3*g* is suppressed. Furthermore, in another embodiment, a heat insulating material is provided which covers the nozzle 3*c*.

The various embodiments which were explained up to here may be combined.

EXAMPLES

Examples 1 to 5

A nonwoven fabric in the form of a roll was provided. The characteristics of the nonwoven fabric are shown in Table 1. In Table 1, WF indicates the width of the nonwoven fabric, tm indicates the thickness of the nonwoven fabric before being wound up in a roll R, t0 indicates the thickness of the nonwoven fabric before being unwound from the roll and loaded into the bulk restoring system. The thickness of the nonwoven fabric was measured using a thickness measuring device FS-60DS made by Daiei Kagaku Seiki. The area of the pressing plates was 20 $cm^2$ (circle), while the measurement load was 0.3 kPa (3 $gf/cm^2$).

TABLE 1

| | |
|---|---|
| Web forming method | Card method |
| Fiber bonding method | Air through method (hot bonding) |
| Fiber structure | Core-sheath structure |
| Material of core | Polyethylene terephthalate |
| Material of sheath | Polyethylene |
| Multilayer structure of fiber | 2-layer structure |
| Top layer | |
| Fiber length (mm) | 45 |
| Denier (dtex) | 1.3 |
| Basis weight ($g/m^2$) | 7 |
| Bottom layer | |
| Fiber length (mm) | 45 |
| Denier (dtex) | 2.2 |
| Basis weight ($g/m^2$) | 17 |
| Total basis weight ($g/m^2$) | 24 |
| WF (m) | 0.082 |
| tm (mm) | 1.34 |
| t0 (mm) | 0.35 |

The bulk restoring system of the embodiment which is shown from FIG. 1 to FIG. 3 was used to treat a nonwoven fabric to restore bulk. As the nozzle 3*c*, a Y747-304SS made by Spraying Systems was used. As the flowmeter 3*ba*, PFD-802-40 made by CKD was used. As the regulator 3*d*, an AR30-03 made by SMC was used. As the electric heater 3*e*, a Microcable Air Heater made by Sakaguchi E. H. Voc (Model Type: MCA-3P-5000, 200V, 5 kW) was used.

The treatment conditions from Examples 1 to 5 are shown in Table 2. In Table 2, THAi indicates the temperature of the air at the inlet of the heating chamber, qHA indicates the quantity of flow of air (0° C.) which is discharged from the compressor, SHA (=W3g·H3g) indicates the flow area of air in the heating chamber, VHA (=qHA/SHA) indicates the linear speed of air in the heating chamber, VF indicates the speed of conveyance of the nonwoven fabric, τH (=L3g/VF) indicates the heating time of the nonwoven fabric, that is, the time during which the nonwoven fabric is present in the heating chamber, and QHA indicates the quantity of air which is effective for restoring bulk of the nonwoven fabric.

TABLE 2

| | Ex. 1 | Ex. 2 | Ex. 3 | Ex. 4 | Ex. 5 |
|---|---|---|---|---|---|
| THAi (° C.) | | | 80 | | |
| qHA ($m^3$/min (0° C.)) | | | 0.44 | | |
| L3g (m) | | | 1 | | |
| W3g (m) | | | 0.1 | | |
| H3g (m) | | | 0.003 | | |
| SHA ($m^2$) | | | 0.0003 | | |
| VHA (m/min) | | | 1467 | | |
| VF (m/min) | 5 | 10 | 20 | 40 | 80 |
| τH (sec) | 12 | 6 | 3 | 1.5 | 0.75 |
| QHA (L (0° C.)) | 87.7 | 43.7 | 21.7 | 10.7 | 5.2 |

The effective air quantity QHA was calculated in Examples 1 to 5 by using the following equation:

$$QHA=(VHA-VF)\cdot SHA\cdot \tau H$$

The thickness t of the nonwoven fabric after restoration of bulk was measured at various effective air quantities QHA, then the bulk restoration rate RR of the nonwoven fabric was calculated. To change the effective air quantity QHA, the speed of conveyance VF of the nonwoven fabric was changed. The bulk restoration rate RR was calculated by using the following equation:

$$RR(\%)=(t-t0)/(tm-t0)\cdot 100$$

Comparative Examples 1 to 3

Figure 6:
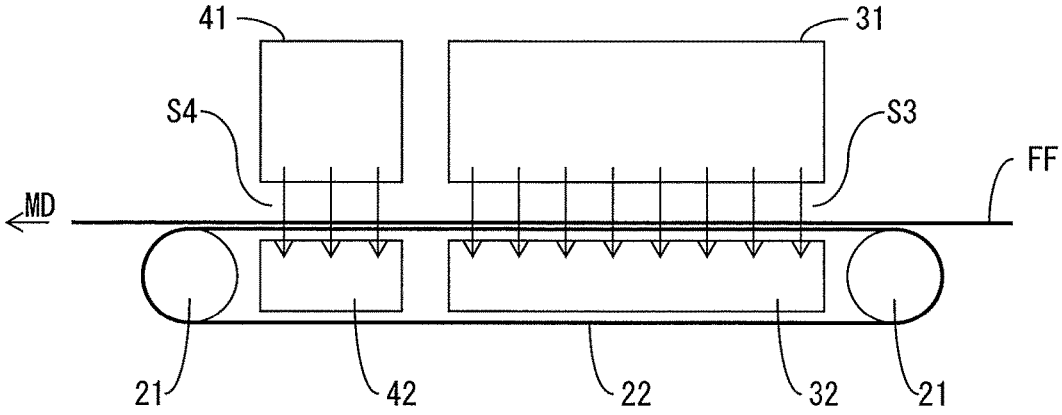
FIG. 6 is an overall view of a bulk restoring system of a comparative example.

A nonwoven fabric similar to Examples 1 to 5 was provided. The bulk restoring system which was shown in FIG. 6 was used for treating the nonwoven fabric to restore bulk. Referring to FIG. 6, the bulk restoring system from Comparative Examples 1 to 3 was provided with an air permeable belt 22 driven by a pair of rollers 21, 21. The nonwoven fabric FF which was unwound from the roll was conveyed on the belt 22 in the machine direction MD. The bulk restoring system was further provided with a hot air feeder 31 which feeds hot air, a suction device 32 which sucks air from the hot air feeder 31, a cold air feeder 41 which feeds cold air, and a suction device 42 which sucks air from the cold air feeder 41. The hot air feeder 31 was comprised of a fan. The hot air feeder 31 and the suction device 32 were arranged facing each other across a space S3, while the cold air feeder 41 and the suction device 42 were arranged facing each other across the space S4. The belt 22 passed through these spaces S3 and S4, therefore the nonwoven fabric FF was conveyed through the inside of the spaces S3 and S4. At the same time, hot air was fed from the hot air feeder 31 vertically to the surface of the nonwoven fabric FF. This hot air passed through the nonwoven fabric FF, then was sucked in by the suction device 32. In the same way, cold air was fed from the cold air feeder 41 vertical to the surface of the nonwoven fabric FF. The cold air passed through the nonwoven fabric FF, then was sucked in by the suction device 42.

The treatment conditions of Comparative Examples 1 to 3 are shown in Table 3. In Table 3, THAi' indicates the temperature of the air which flows out from the hot air feeder 31, qHA' is the quantity of air which is discharged from the hot air feeder 31 (80° C.), Ps' is the static pressure at the hot air feeder 31 (80° C.), L3g' and W3g' are the machine direction length and width of the parts of the hot air feeder 31 and suction device 32 where the air flow is generated, SHA' (=L3g'·W3g') indicates the flow area of air in the space S3, VHA' (=qHA'/SHA') indicates the linear speed of air in the space S3, SF'(=L3g'·WF) indicates the area of the nonwoven fabric part which is positioned in the space S3, that is, the nonwoven fabric part through which air passes, VF' indicates the speed of conveyance of the nonwoven fabric, 'τH' indicates the heating time, that is, the time during which the nonwoven fabric is present in the space S3, and QHA' indicates the quantity of air (0° C.) which is effective for restoring bulk of the nonwoven fabric.

TABLE 3

| | Comp. Ex. 1 | Comp. Ex. 2 | Comp. Ex. 3 |
|---|---|---|---|
| THAi' (° C.) | | 80 | |
| qHA' ($m^3$/min (80° C.)) | | 220 | |
| Ps' (kPa (80° C.)) | | 1.7 | |
| L3g' (mm) | | 1.8 | |
| W3g' (mm) | | 0.7 | |
| SHA' ($m^2$) | | 1.26 | |
| VHA' (m/min) | | 175 | |
| SF' ($m^2$) | | 0.148 | |

TABLE 3-continued

| | Comp. Ex. 1 | Comp. Ex. 2 | Comp. Ex. 3 |
|---|---|---|---|
| VF' (m/min) | 10 | 20 | 40 |
| τH' (sec) | 10.8 | 5.4 | 2.7 |
| QHA' (L (0° C.)) | 3648 | 1824 | 912 |

The effective air quantity QHA' was calculated in Comparative Examples 1 to 3 by using the following equation: Note that, C is the conversion coefficient for finding the amount of air at 0° C. considering the static pressure Ps at the hot air feeder 31.

$$QHA'=SF'\cdot VHA'\cdot \tau H'\cdot C$$

The thickness t of the nonwoven fabric after restoration of bulk was measured at various effective air quantities QHA', then the bulk restoration rate RR of the nonwoven fabric was calculated.

Results

The thickness t and bulk restoration rate RR of the nonwoven fabric at various effective air quantities QHA and QHA' are shown in Table 4.

TABLE 4

| | Ex. 1 | Ex. 2 | Ex. 3 | Ex. 4 | Ex. 5 | Comp. Ex. 1 | Comp. Ex. 2 | Comp. Ex. 3 |
|---|---|---|---|---|---|---|---|---|
| QHA, QHA' (L (0° C.)) | 87.7 | 43.7 | 21.7 | 10.7 | 5.2 | 3648 | 1824 | 912 |
| t (mm) | 1.27 | 1.26 | 1.19 | 1.12 | 0.84 | 1.26 | 1.23 | 1.12 |
| RR (%) | 92.9 | 91.9 | 84.8 | 77.8 | 49.5 | 91.9 | 88.9 | 77.8 |

For example, if compared with the effective air quantity which is required for making the bulk restoration rate RR about 77.8%, the quantity was 10.7 liters at Example 4, while was 912 liter at Comparative Example 3. In this way, the effective air quantity QHA of Example 4 was about ⅛sth of the effective air quantity QHA' of Comparative Example 3. Therefore, in Examples 1 to 5, a smaller dimension system could be used to more effectively reduce the bulk of the nonwoven fabric.

REFERENCE SIGNS LIST

1 bulk restoring system
2 conveyor
3 heater
3*e* electric heater
3*c* nozzle
3*g* heating chamber
3*gi* inlet
3*go* outlet
4 cooler
F nonwoven fabric
R roll
MD machine direction

The invention claimed is:

1. A method for restoring bulk of a strip-shaped nonwoven fabric, which method includes a step of providing a heating chamber which has an inlet and outlet, a step of conveying a nonwoven fabric so as to enter the heating chamber through the inlet, proceed through the inside of the heating chamber, then exit the heating chamber through the outlet while feeding a heated fluid by a speed faster than the speed of conveyance of the nonwoven fabric so as to enter the heating chamber through one of the inlet and outlet, proceed through the inside of the heating chamber while contacting the nonwoven fabric, then exit from the inside of the heating chamber through the other of the inlet and outlet.

2. The method according to claim 1, wherein the heated fluid enters the heating chamber through the inlet and exits the heating chamber through the outlet.

3. The method according to claim 1, wherein the nonwoven fabric is conveyed inside the heating chamber without being supported.

4. The method according to claim 1, wherein the heating chamber is partitioned by two partition walls which extend from the inlet to the outlet while being separated from each other and wherein the nonwoven fabric is conveyed in the heating chamber so that the two surfaces of the nonwoven fabric continue to face these partition walls.

5. The method according to claim 1, further comprising a step of cooling the nonwoven fabric which exits the heating chamber.

6. The method according to claim 1, wherein the nonwoven fabric includes thermoplastic fiber and wherein a temperature of the heated fluid is less than a melting point of the thermoplastic fiber, but not lower than 50 degrees centigrade lower than the melting point.

7. The method according to claim 1, wherein the nonwoven fabric has thermoplastic fiber which has crimps.

8. The method according to claim 2, wherein the nonwoven fabric is conveyed inside the heating chamber without being supported.

9. The method according to claim 2, wherein the heating chamber is partitioned by two partition walls which extend from the inlet to the outlet while being separated from each other and wherein the nonwoven fabric is conveyed in the heating chamber so that the two surfaces of the nonwoven fabric continue to face these partition walls.

10. The method according to claim 3, wherein the heating chamber is partitioned by two partition walls which extend from the inlet to the outlet while being separated from each other and wherein the nonwoven fabric is conveyed in the heating chamber so that the two surfaces of the nonwoven fabric continue to face these partition walls.

11. The method according to claim 8, wherein the heating chamber is partitioned by two partition walls which extend from the inlet to the outlet while being separated from each other and wherein the nonwoven fabric is conveyed in the heating chamber so that the two surfaces of the nonwoven fabric continue to face these partition walls.

12. The method according to claim 2, further comprising a step of cooling the nonwoven fabric which exits the heating chamber.

13. The method according to claim 3, further comprising a step of cooling the nonwoven fabric which exits the heating chamber.

14. The method according to claim 4, further comprising a step of cooling the nonwoven fabric which exits the heating chamber.

15. The method according to claim 8, further comprising a step of cooling the nonwoven fabric which exits the heating chamber.

16. The method according to claim 9, further comprising a step of cooling the nonwoven fabric which exits the heating chamber.

17. The method according to claim 10, further comprising a step of cooling the nonwoven fabric which exits the heating chamber.

18. The method according to claim 11, further comprising a step of cooling the nonwoven fabric which exits the heating chamber.

19. The method according to claim 2, wherein the nonwoven fabric includes thermoplastic fiber and wherein a temperature of the heated fluid is less than a melting point of the thermoplastic fiber, but not lower than 50 degrees centigrade lower than the melting point.

20. A system for restoring bulk of a strip-shaped nonwoven fabric, which system includes a heating chamber which has an inlet and outlet, a conveyor which conveys a nonwoven fabric to enter the heating chamber through the inlet, proceed through the inside of the heating chamber, then exit the heating chamber through the outlet, and a feeder which feeds a heated fluid by a speed faster than the speed of conveyance of the nonwoven fabric so as to enter the heating chamber through one of the inlet and outlet, proceed through the inside of the heating chamber while contacting the nonwoven fabric, then exit from the inside of the heating chamber through the other of the inlet and outlet.

* * * * *